US009327517B2

(12) United States Patent
Castells De Monet et al.

(10) Patent No.: US 9,327,517 B2
(45) Date of Patent: May 3, 2016

(54) SETS OF IDLE ROLLERS IN CIRCUMFERENTIAL AND STAGGERED ARRANGEMENT AND INCLUDING IDLE ROLLERS SPACED APART FROM EACH OTHER TO TRANSPORT SUBSTRATE

(75) Inventors: Raimon Castells De Monet, Barcelona (ES); Daniel Gutiérrez Garcia, Barcelona (ES); Roger Terradellas Callau, Sant Cugat del Valles (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 892 days.

(21) Appl. No.: 13/457,581

(22) Filed: Apr. 27, 2012

(65) Prior Publication Data

US 2013/0286082 A1 Oct. 31, 2013

(51) Int. Cl.

| | |
|---|---|
| ***B41J 11/00*** | (2006.01) |
| ***B41J 13/02*** | (2006.01) |
| ***B41J 15/04*** | (2006.01) |

(52) U.S. Cl.
CPC ..... *B41J 11/001* (2013.01); *B41J 13/02* (2013.01); *B41J 15/04* (2013.01)

(58) Field of Classification Search
USPC ..... 242/615.2
See application file for complete search history.

(56) References Cited

U.S. PATENT DOCUMENTS

| | | | | |
|---|---|---|---|---|
| 4,802,790 | A * | 2/1989 | Tondini | 404/132 |
| 2007/0025788 | A1 * | 2/2007 | deJong et al. | 399/388 |
| 2008/0166164 | A1 * | 7/2008 | Park | 399/397 |

* cited by examiner

*Primary Examiner* — Emmanuel M Marcelo
*Assistant Examiner* — Angela K Caligiuri
(74) *Attorney, Agent, or Firm* — Fabian Van Cott

(57) ABSTRACT

A diverter assembly to transport a substrate along a transport path includes a plurality of sets of idle rollers and at least one support member. Each set of idle rollers may include a longitudinal axis and a plurality of respective idle rollers disposed along the respective longitudinal axis. Each idle roller of adjacent sets of idle rollers may be in a staggered arrangement with each other. The at least one roller support member may rotatably support the respective sets of idle rollers. The plurality of sets of idle rollers may be in a circumferential arrangement with each other.

20 Claims, 7 Drawing Sheets

SETS OF IDLE ROLLERS IN CIRCUMFERENTIAL AND STAGGERED ARRANGEMENT AND INCLUDING IDLE ROLLERS SPACED APART FROM EACH OTHER TO TRANSPORT SUBSTRATE

BACKGROUND

Image forming apparatuses such as large format printers may include fluid applicator units to provide fluid such as ink on substrates. The image forming apparatuses may include diverters to transport substrates to and from the fluid applicator units along a transport path.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Image forming systems such as large format printers may include fluid applicator units to eject fluid such as ink on substrates. The respective image forming system may include a diverter such as a continuous idle roller to transport a substrate to and from the fluid applicator unit along a transport path. The diverter may change the direction of the respective substrate. The diverter in a form of a continuous idle roller, however, may cause undesired collateral effects such as substrate advance issues, wrinkles, temperature variations, and skew convergence to the substrate as it is bent and changes direction. Such undesired collateral effects may result in image quality defects, lower output productivity, and/or increase fluid applicator unit failures.

In examples, an image forming system includes, amongst other things, at least one diverter assembly to transport a substrate along a transport path. The diverter assembly may include a plurality of sets of idle rollers and at least one roller support member. Each set of idle rollers may include a longitudinal axis and a plurality of respective idle rollers disposed along the respective longitudinal axis. Each idle roller of adjacent sets of idle rollers may be in a staggered arrangement with each other. The at least one roller support member may rotatably support the respective sets of idle rollers. Additionally, the plurality of sets of idle rollers may be in a circumferential arrangement with each other. Accordingly, the diverter assembly using the plurality of staggered and circumferentially arranged idle rollers to reduce undesired collateral effects such as substrate advance issues, wrinkles, temperature variations, and skew convergence to the substrate by creating a rolling surface that reduces friction between the substrate and diverter assembly as compared to the single continuous idle roller. Consequently, image quality defects, lower output productivity, and/or increase fluid applicator unit failures may be reduced.

Figure 1:
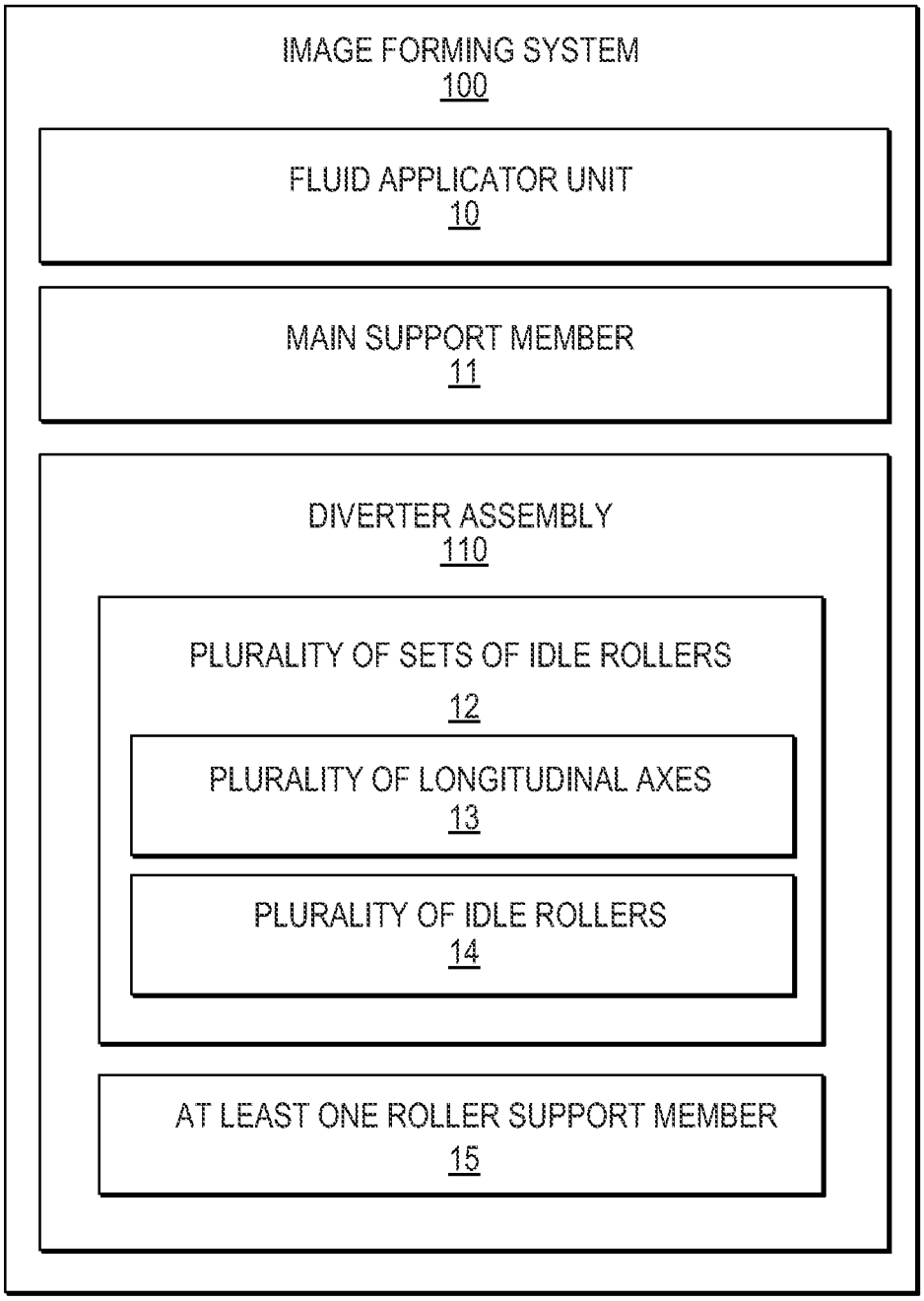
FIG. 1 is a block diagram illustrating an image forming system according to an example.
Figure 2:
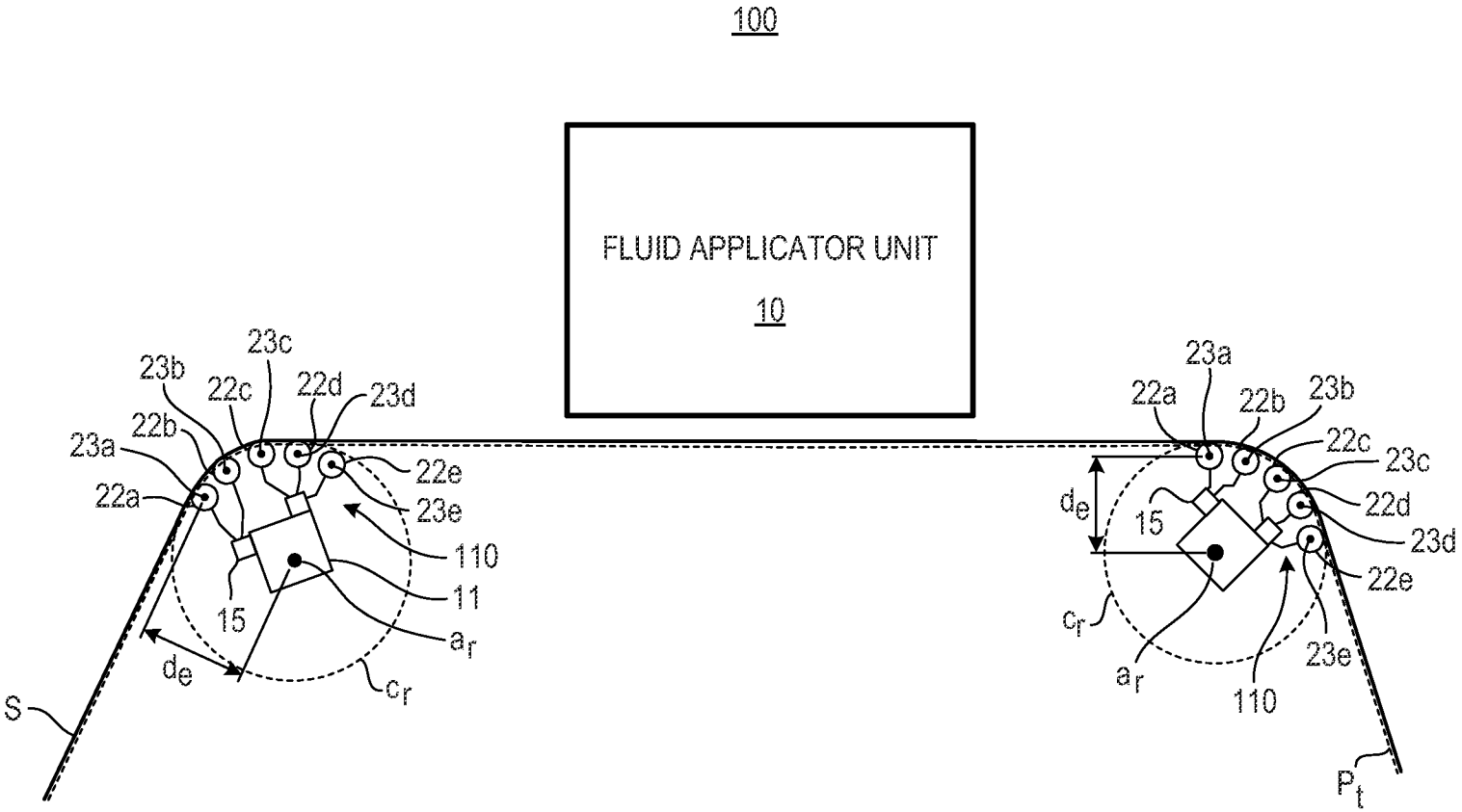
FIG. 2 is a side view illustrating a portion of the image forming system of FIG. 1 according to an example.

FIG. 1 is block diagram illustrating an image forming system according to an example. FIG. 2 is a side view illustrating a portion of the image forming system of FIG. 1 according to an example. Referring to FIGS. 1 and 2, in some examples, an image forming system 100 includes a fluid applicator unit 10, a main support member 11, and at least one diverter assembly 110. The fluid applicator unit 10 may form an image on a substrate S. For example, in some examples, the fluid applicator unit 10 may include at least one inkjet print head to eject ink in the form of drops. For example, the fluid applicator unit 10 may be a page wide inkjet print head array that includes a plurality of inkjet print heads that extend across a width of a transport path $P_t$. That is, the plurality of inkjet print heads may extend across a width of a substrate S passing into a print zone.

In some examples, the image forming system 100 may include a plurality of diverter assemblies 110, a plurality of main support members 11, a plurality of roller support members 15 formed of sheet metal, and each one of the idle rollers may be formed of plastic. In some examples, the respective idle rollers may include a low friction surface, a smooth surface, low thermal conduction, and low moment of inertia. For example, the coefficient of friction may be in a range of about 0.03 to 0.1 of the respective idle rollers against steel. The low thermal conduction may be less than 0.3 watts per meter Kelvin (W/(m·K)), and the low moment of inertia may be less than $2\cdot10^{-6}$ kg·m$^2$ for each idle roller.

Referring to FIGS. 1 and 2, the diverter assembly 110 may transport a substrate S along a transport path $P_t$. The diverter assembly 110 may include a plurality of sets of idle rollers 12 and at least one roller support member 15. Each set of idle rollers 22*a*, 22*b*, 22*c*, 22*d*, and 22*e* may include a respective longitudinal axis 23*a*, 23*b*, 23*c*, 23*d*, and 23*e* and a plurality of respective idle rollers 14 disposed along the respective longitudinal axis 23*a*, 23*b*, 23*c*, 23*d*, and 23*e*. Each idle roller of adjacent sets of idle rollers may be in a staggered arrangement with each other. The at least one roller support member 15 may support the respective sets of idle rollers 22*a*, 22*b*, 22*c*, 22*d*, and 22*e* and may couple a respective idle roller to the main support member 11. For example, the at least one roller support member 15 may rotatably support the respective sets of idle rollers 22*a*, 22*b*, 22*c*, 22*d*, and 22*e* to enable them to rotate about their respective longitudinal axes.

Referring to FIG. 2, in some examples, the diverter assembly 110 may include a single roller support member 15. Alternatively, the diverter assembly 110 may include a plurality of roller support members 15. The plurality of sets of idle rollers 22*a*, 22*b*, 22*c*, 22*d*, and 22*e* may be in a circumferential arrangement with each other. For example, each one of the idle rollers may be equidistant $d_e$ from a reference longitudinal axis $a_r$ of a reference cylinder and be disposed along a circumference $c_r$ of the reference cylinder as illustrated in FIG. 2. That is, each one of a respective longitudinal axis 23*a*, 23*b*, 23*c*, 23*d*, and 23*e* of the corresponding set of idle rollers 22*a*, 22*b*, 22*c*, 22*d*, and 22*e* may be spaced apart from the reference longitudinal axis $a_r$ of the reference cylinder by a distance $d_e$.

Figure 3A:
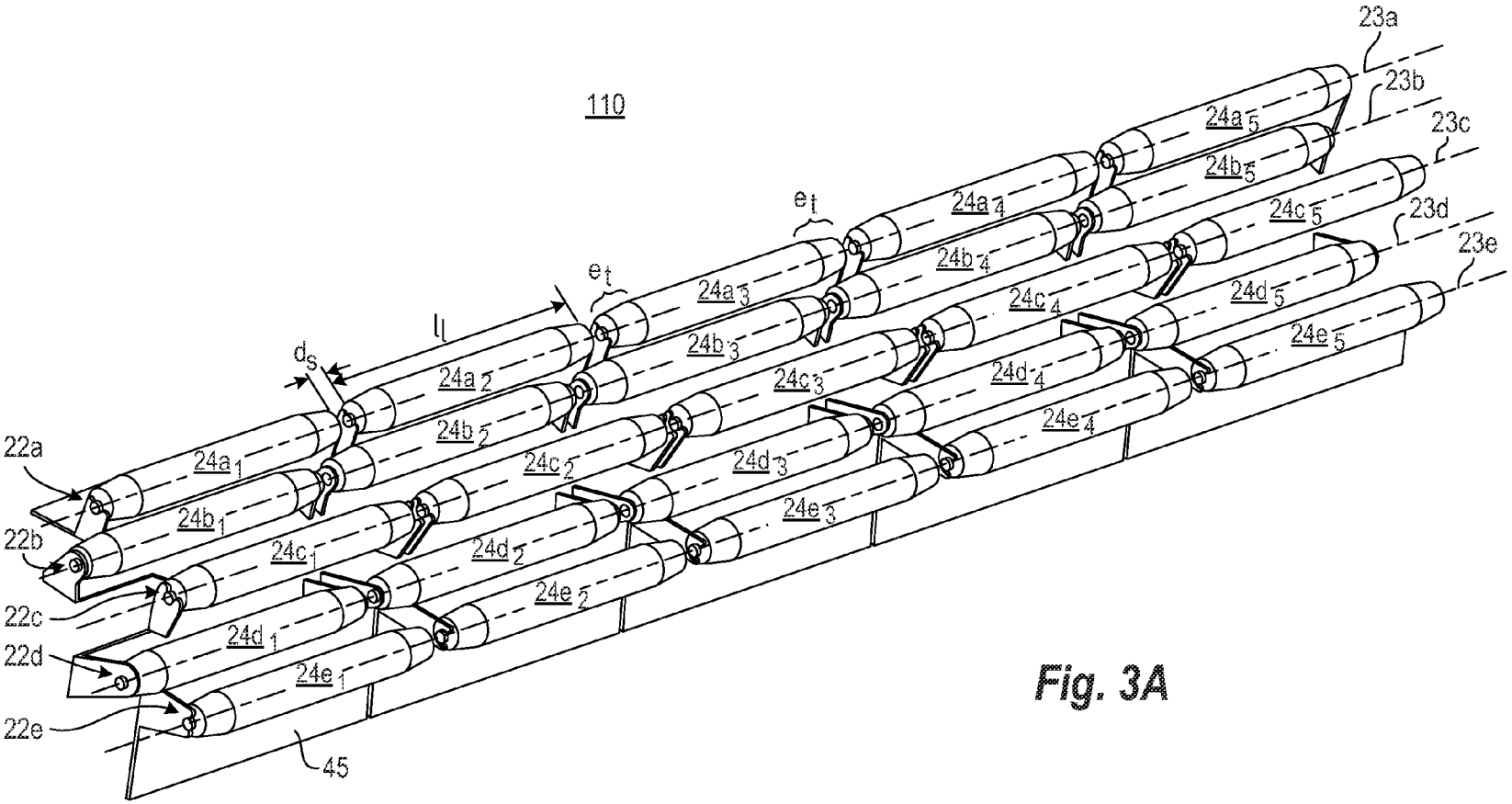
FIG. 3A is a perspective view illustrating a diverter assembly of the image forming system of FIG. 1 according to an example.
Figure 3B:
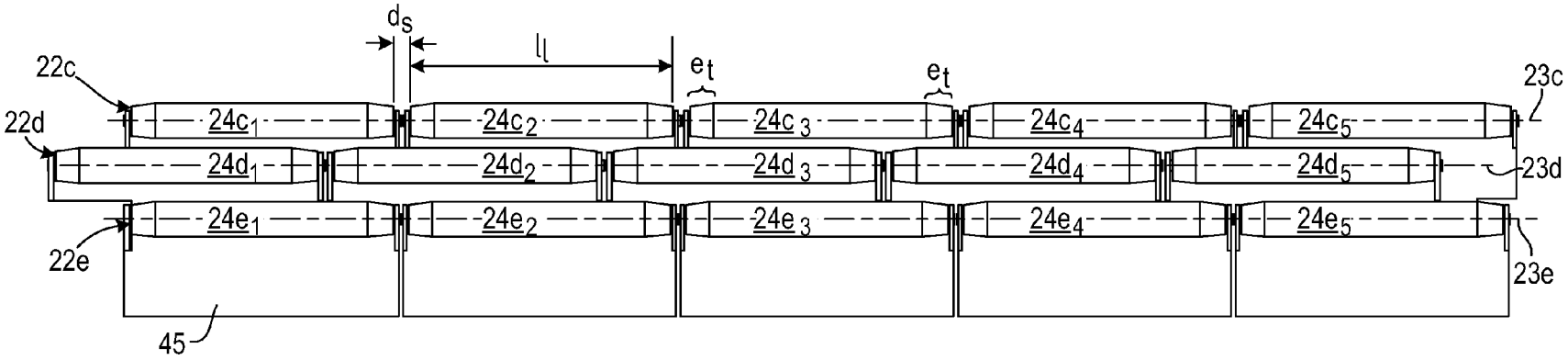
FIG. 3B is a front view illustrating the diverter assembly of FIG. 3A according to an example.

FIG. 3A is a perspective view illustrating a diverter assembly of the image forming system of FIG. 1 according to an example. FIG. 3B is a front view illustrating a diverter assembly of the image forming system of FIG. 3B according to an example. Referring to FIGS. 3A and 3B, in some examples, the plurality of sets of idle rollers 12 includes at least three sets of idle rollers 22*a*, 22*b*, and 22*c*. For example, the plurality of sets of idle rollers 12 may include five sets of idle rollers 22*a*, 22*b*, 22*c*, 22*d*, and 22*e*. In some examples, each one of the plurality of sets of idle rollers 22*a*, 22*b*, 22*c*, 22*d*, and 22*e* includes at least three idle rollers 24$a_1$, 24$a_2$, 24$a_3$, 24$b_1$, 24$b_2$, 24$b_3$, 24$c_1$, 24$c_2$, 24$c_3$, 24$d_1$, 24$d_2$, 24$d_3$, 24$e_1$, 24$e_2$, and 24$e_3$. For example, each one of the plurality of sets of idle rollers 22*a*, 22*b*, 22*c*, 22*d*, and 22*e* may include five idle rollers 24$a_1$, 24$a_2$, 24$a_3$, 24$a_4$, 24$a_5$, . . . , 24$e_1$, 24$e_2$, 24$e_3$, 24$e_4$, and 24$e_5$.

In some examples, a distance of space $d_s$ between adjacent idle rollers 24$a_1$ and 24$a_2$ along a corresponding longitudinal axis 23*a* is smaller than a longitudinal length $l_l$ of the respective adjacent idle rollers 24$a_1$ and 24$a_2$. Additionally, each idle roller 24$a_1$, 24$a_2$, 24$a_3$, 24$a_4$, 24$a_5$, 24$b_1$, 24$b_2$, 24$b_3$, 24$b_4$, and 24$b_5$ of adjacent sets of idle rollers 22*a* and 22*b* may be in a staggered arrangement with each other. For example, idle roller 24$b_2$ may be disposed below and overlap a portion of idle rollers 24$a_1$ and 24$a_2$. In some examples, the respective idle rollers 24$a_1$, 24$a_2$, 24$a_3$, 24$a_4$, 24$a_5$, . . . , 24$e_1$, 24$e_2$, 24$e_3$, 24$e_4$, and 24$e_5$ may be disposed in a quincunx arrangement. For example, a quincunx arrangement may correspond to a fully staggered formation. Referring to FIGS. 3A and 3B, in some examples, each one 24$a_1$, 24$a_2$, 24$a_3$, 24$a_4$, 24$a_5$, . . . , 24$e_1$, 24$e_2$, 24$e_3$, 24$e_4$, and 24$e_5$ of the idle rollers of the plurality of idle rollers 14 may be substantially a same size. In some examples, each one 24$a_1$, 24$a_2$, 24$a_3$, 24$a_4$, 24$a_5$, . . . , 24$e_1$, 24$e_2$, 24$e_3$, 24$e_4$, and 24$e_5$ of the idle rollers may have tapered ends $e_t$.

Figure 4:
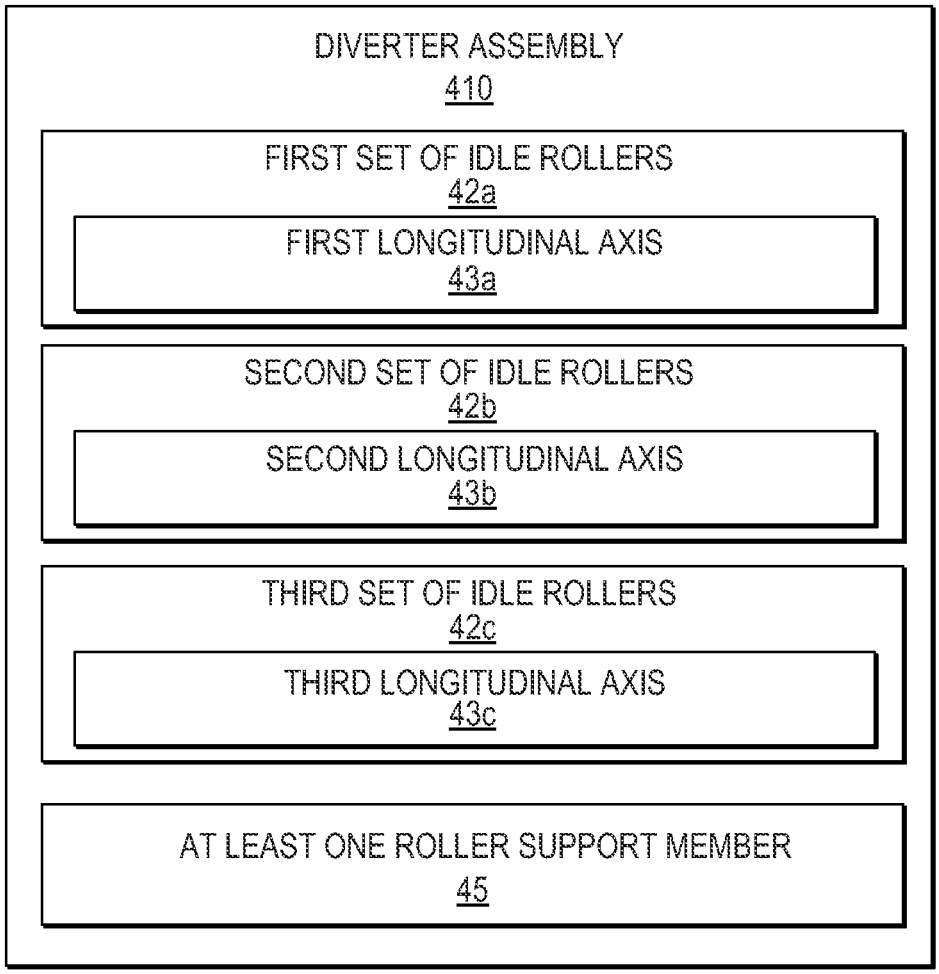
FIG. 4 is a block diagram illustrating a diverter assembly usable with an image forming system according to an example.
Figure 5:
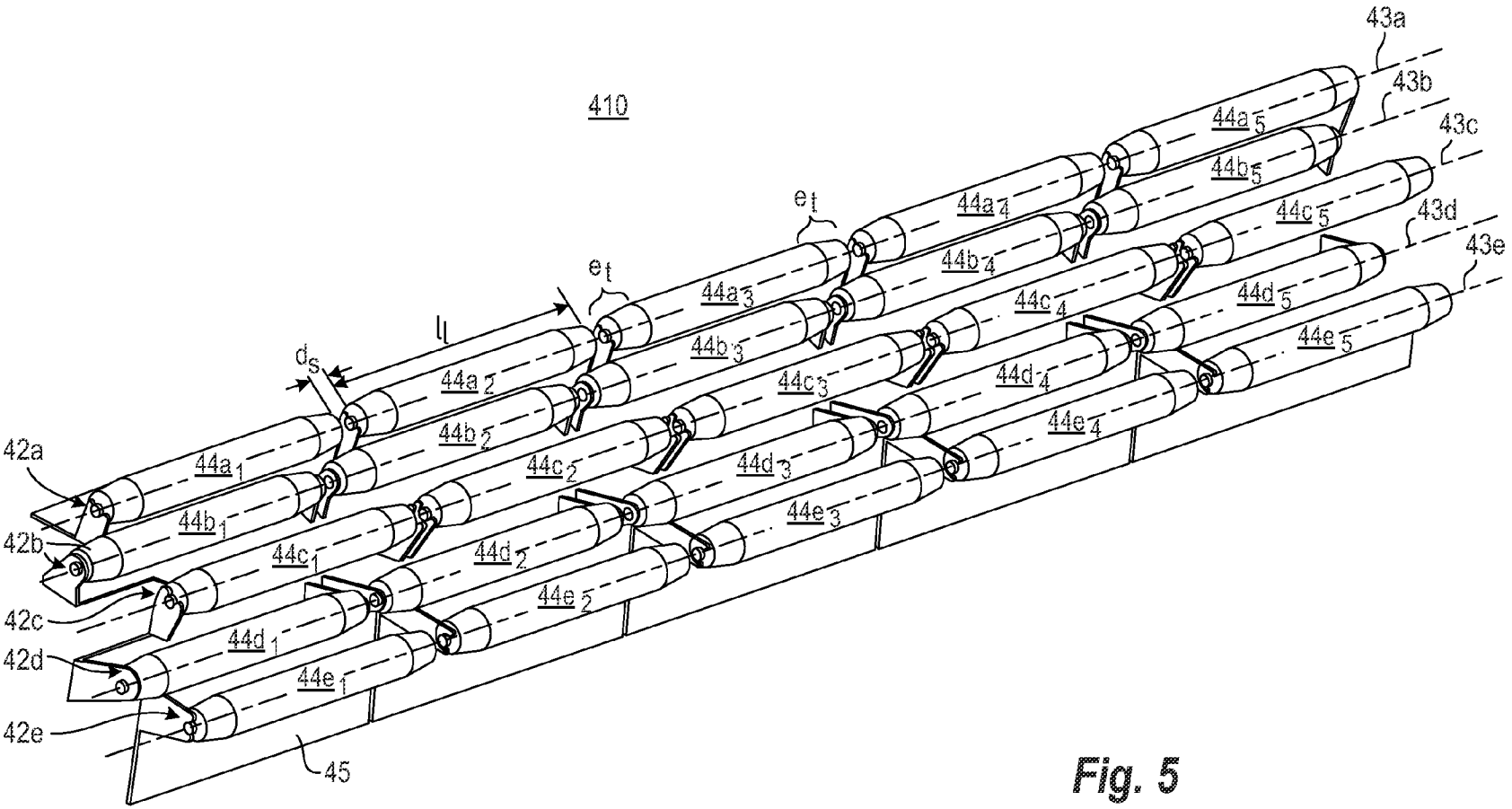
FIG. 5 is a perspective view illustrating the diverter assembly of FIG. 4 according to an example.

FIG. 4 is a block diagram illustrating a diverter assembly according to an example. FIG. 5 is a perspective view illustrating a diverter assembly of FIG. 4 according to an example. Referring to FIGS. 4 and 5, in some examples, a diverter assembly 410 may transport a substrate along a transport path and be usable with an image forming system. The diverter assembly 410 may include a first set of idle rollers 42*a*, a second set of idle rollers 42*b*, a third set of idle rollers 42*c*, and at least one roller support member 45. The first set of idle rollers 42*a* may be disposed along a first longitudinal axis 43*a* and spaced apart from each other. The second set of idle rollers 42*b* may be disposed along a second longitudinal axis 43*b* and spaced apart from each other. Each one 44$b_1$, 44$b_2$, 44$b_3$, 44$b_4$, and 44$b_5$ of the second set of idle rollers 42*b* may be in a staggered arrangement with each one 44$a_1$, 44$a_2$, 44$a_3$, 44$a_4$, and 44$a_5$ of the respective idle rollers of the first set of idle rollers 42*a* and each one 44$c_1$, 44$c_2$, 44$c_3$, 44$c_4$, and 44$c_5$ of the respective idle rollers of the third set of idle rollers 42*c*.

Referring to FIGS. 4 and 5, in some examples, each one 44$a_1$, 44$a_2$, 44$a_3$, 44$a_4$, 44$a_5$, . . . , 44$e_1$, 44$e_2$, 44$e_3$, 44$e_4$, and 44$e_5$ of the idle rollers may be formed of plastic. The at least one roller support member 45 may support the first, second, and third set of idle rollers 42*a*, 42*b*, and 42*c*. For example, the at least one roller support member 45 may rotatably support the respective sets of idle rollers 42*a*, 42*b*, and 42*c* to enable them to rotate about their respective longitudinal axes. The first, second, and third set of idle rollers 42*a*, 42*b*, and 42*c* may be in a circumferential arrangement with each other. In some examples, each one of the first, second, and third set of idle rollers 42*a*, 42*b*, and 42*c* may include at least three idle rollers 44$a_1$, 44$a_2$, 44$a_3$, 44$b_1$, 44$b_2$, 44$b_3$, 44$c_1$, 44$c_2$, and 44$c_3$. For example, each one of the first, second, and third sets of idle rollers 42*a*, 42*b*, and 42*c* may include five idle rollers 44$a_1$, 44$a_2$, 44$a_3$, 44$a_4$, 44$a_5$, 44$b_1$, 44$b_2$, 44$b_3$, 44$b_4$, 44$b_5$, 44$c_1$, 44$c_2$, 44$c_3$, 44$c_4$, and 44$c_5$. Additionally, each one 44$a_1$, 44$a_2$, 44$a_3$, 44$a_4$, 44$a_5$, 44$b_1$, 44$b_2$, 44$b_3$, 44$b_4$, 44$b_5$, 44$c_1$, 44$c_2$, 44$c_3$, 44$c_4$, and 44$c_5$ of the idle rollers of the first, second, and third sets of idle rollers 42*a*, 42*b*, 42*c* may be substantially a same size.

Referring to FIGS. 4 and 5, in some examples, the diverter assembly 410 may also include a fourth set of idle rollers 42*d* and a fifth set of idle rollers 42*e*. The fourth set of idle rollers 42*d* may be disposed along a fourth longitudinal axis 43*d* and spaced apart from each other. Each one 44$d_1$, 44$d_2$, 44$d_3$, 44$d_4$, and 44$d_5$ of the respective idle rollers of the fourth set of idle rollers 43*d* may be in a staggered arrangement with each one 44$c_1$, 44$c_2$, 44$c_3$, 44$c_4$, and 44$c_5$ of the respective idle rollers of the third set of idle rollers 42*c* and each one 44$e_1$, 44$e_2$, 44$e_3$, 44$e_4$, and 44$e_5$ of the respective idle rollers of the fifth set of idle rollers 42*e*. The fifth set of idle rollers 42*e* may be disposed along a fifth longitudinal axis 43*e* and spaced apart from each other. The first, second, third, fourth and fifth sets of idle rollers 42*a*, 42*b*, 42*c*, 42*d*, and 42*e* may be in a circumferential arrangement with each other and are supported by the at least one roller support member 45.

Referring to FIGS. 4 and 5, for example, each one 44*a*1, 44*a*2, 44*a*3, 44*a*4, 44*a*5, . . . , 44*e*1, 44*e*2, 44*e*3, 44*e*4, and 44*e*5 of the idle rollers is equidistant de from a reference longitudinal axis ar. In some examples, a distance of space ds between adjacent idle rollers 44*a*1 and 44*a*2 along a corresponding longitudinal axis 43*a* is smaller than a longitudinal length $l_l$ of the respective adjacent idle rollers 44*a*1 and 44*a*2. In some examples, the respective idle rollers 44*a*1, 44*a*2, 44*a*3, 44*a*4, 44*a*5, . . . , 44*e*1, 44*e*2, 44*e*3, 44*e*4, and 44*e*5 may be disposed in a quincunx arrangement.

Figure 6:
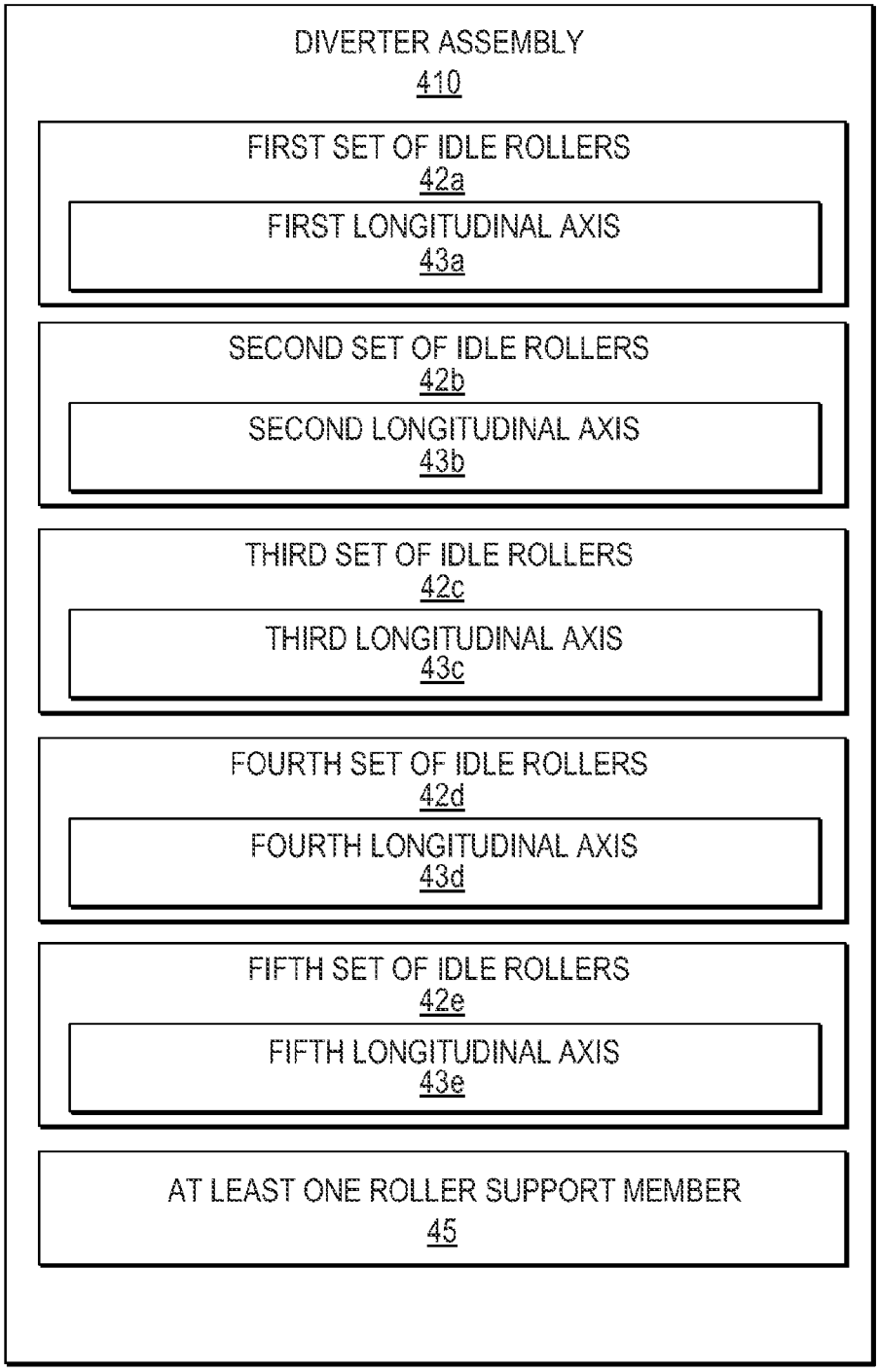
FIG. 6 is a block diagram illustrating the diverter assembly of FIG. 4 according to an example.

FIG. 6 is a block diagram illustrating the diverter assembly of FIG. 4 according to an example. Referring to FIG. 6, in some examples, a diverter assembly 410 may transport a substrate along a transport path and be usable with an image forming system. The diverter assembly 410 may include a first set of idle rollers 42*a*, a second set of idle rollers 42*b*, a third set of idle rollers 42*c*, a fourth set of idle rollers 42*d*, a fifth set of idle rollers 42*e*, and at least one roller support member 45. The first set of idle rollers 42*a* may be disposed along a first longitudinal axis 43*a* and spaced apart from each other. The second set of idle rollers 42*b* may be disposed along a second longitudinal axis 43*b* and spaced apart from each other. Each one 44*b*1, 44*b*2, 44*b*3, 44*b*4, and 44*b*5 of the second set of idle rollers 42*b* is in a staggered arrangement with each one 44*a*1, 44*a*2, 44*a*3, 44*a*4, and 44*a*5 of the respective idle rollers of the first set of idle rollers 42*a* and each one 44*c*1, 44*c*2, 44*c*3, 44*c*4, and 44*c*5 of the respective rollers of the third set of idle rollers 42*c*.

Referring to FIG. 6, in some examples, the fourth set of idle rollers 42*d* may be disposed along a fourth longitudinal axis 43*d* and spaced apart from each other. Each one of the fourth set of idle rollers 42*d* may be in a staggered arrangement with each one of the respective idle rollers of the third set of idle rollers 42*c* and each one of the respective idle rollers of the fifth set of idle rollers 42*e*. The fifth set of idle rollers 42*e* may be disposed along a fifth longitudinal axis 43*e* and spaced apart from each other. The first, second, third, fourth and fifth sets of idle rollers 42*a*, 42*b*, 42*c*, 42*d*, and 42*e* may be in a circumferential arrangement with each other and are supported by the at least one roller support member 45. For example, each one of the idle rollers is equidistant de from a reference longitudinal axis ar. In some examples, a distance of space ds between adjacent idle rollers along a corresponding longitudinal axis is smaller than a longitudinal length $l_l$ of the respective adjacent idle rollers.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A diverter assembly to transport a substrate along a transport path usable with an image forming system, the diverter assembly comprising:

at least three rows of idle rollers disposed on a circumference around a reference longitudinal axis, the at least three rows of idle rollers comprising:

a first set of idle rollers disposed along a first longitudinal axis and spaced apart from each other;

a second set of idle rollers disposed along a second longitudinal axis and spaced apart from each other; and a third set of idle rollers disposed along a third longitudinal axis and spaced apart from each other;

wherein the rollers of the second set of idle rollers are in a staggered arrangement with respective idle rollers of the first set of idle rollers and the third set of idle rollers such that rollers in adjacent sets overlap with each other in a direction around the circumference; and at least one roller support member to rotatably support the first, second, and third set of idle rollers; and wherein the substrate travels along the transport path outside the circumference around which are arranged the first, second, and third sets of idle rollers.

2. The diverter assembly according to claim 1, further comprising:

a fifth set of idle rollers disposed along a fifth longitudinal axis and spaced apart from each other; and a fourth set of idle rollers disposed along a fourth longitudinal axis and spaced apart from each other, each one of the fourth set of idle rollers are in a staggered and circumferentially overlapping arrangement with each one of the respective idle rollers of the third set of idle rollers and the fifth set of idle rollers; and wherein the first, second, third, fourth and fifth sets of idle rollers are in a circumferential arrangement with each other and are supported by the at least one roller support member.

3. The diverter assembly of claim 2, wherein the staggered arrangement of the first, second, third, fourth and fifth sets comprises a quincunx staggered arrangement.

4. The diverter assembly according to claim 1, wherein each one of the first, second, and third sets of idle rollers includes at least three idle rollers.

5. The diverter assembly according to claim 4, wherein each one of the first, second, and third sets of idle rollers includes five idle rollers.

6. The diverter assembly according to claim 1, wherein the each one of the idle rollers of the first, second, and third sets of idle rollers is substantially a same size.

7. The diverter assembly according to claim 6, wherein a distance of space between adjacent idle rollers along a corresponding longitudinal axis is smaller than a longitudinal length of the respective adjacent idle rollers.

8. The diverter assembly according to claim 1, wherein each one of the idle rollers comprises plastic.

9. An image forming system, comprising:

a main support member;

a fluid applicator unit to form an image on a substrate; and at least one diverter assembly to transport a substrate along a transport path, comprising:

a plurality of sets of idle rollers, each set of idle rollers having a longitudinal axis and a plurality of respective idle rollers disposed along the respective longitudinal axis, the sets of idle rollers being disposed on a circumference around a reference longitudinal axis;

each idle roller of adjacent sets of idle rollers is in a staggered arrangement with each other such that rollers in adjacent sets overlap with each other in a direction around the circumference; and at least one roller support member to rotatably support the respective sets of idle rollers and to couple a respective idle roller to the main support member; and wherein the substrate travels along the transport path outside the circumference along the outer surface of the circumferentially arranged plurality of sets of idle rollers.

10. The image forming system according to claim 9, wherein the plurality of sets of idle rollers includes at least three sets of idle rollers.

11. The image forming system according to claim 10, wherein the plurality of sets of idle rollers includes five sets of idle rollers.

12. The image forming system according to claim 9, wherein each one of the plurality of sets of idle rollers includes at least three idle rollers.

13. The image forming system according to claim 12, wherein each one of the plurality of sets of idle rollers includes five idle rollers.

14. The image forming system according to claim 9, wherein each one of the idle rollers of the plurality of idle rollers is substantially a same size.

15. The diverter assembly of claim 9, wherein the staggered arrangement of the plurality of sets of idle rollers comprises a quincunx staggered arrangement.

16. The image forming system according to claim 9, wherein a distance of space between adjacent idle rollers along a corresponding longitudinal axis is smaller than a longitudinal length of the respective adjacent idle rollers.

17. The image forming system according to claim 9, wherein the at least one roller support member of the plurality of sets of roller support members further comprises sheet metal and each one of the idle rollers includes plastic.

18. The image forming system according to claim 9, wherein each one of the idle rollers includes tapered ends.

19. The image forming system according to claim 9, wherein the at least one diverter assembly includes a plurality of diverter assemblies.

20. A diverter assembly to transport a substrate along a transport path usable with an image forming system, the diverter assembly comprising:

a first set of idle rollers disposed along a first longitudinal axis and spaced apart from each other;

a second set of idle rollers disposed along a second longitudinal axis and spaced apart from each other;

a third set of idle rollers disposed along a third longitudinal axis and spaced apart from each other;

a fourth set of idle rollers disposed along a fourth longitudinal axis and spaced apart from each other;

a fifth set of idle rollers disposed along a fifth longitudinal axis and spaced apart from each other, wherein the five sets of idle rollers are disposed on a circumference around a reference longitudinal axis and rollers in adjacent sets are staggered so as to overlap with each other in a direction around the circumference; and at least one roller support member to rotatably support the first, second, third, fourth and fifth sets of idle rollers; and wherein the first, second, third, fourth and fifth sets of idle rollers are in a circumferential arrangement with each other equidistant from the reference longitudinal axis wherein the substrate travels along the transport path outside the circumference on which are arranged the sets of idle rollers, and wherein a distance of space between adjacent idle rollers along a corresponding longitudinal axis is smaller than a longitudinal length of the respective adjacent idle rollers, and wherein the staggered arrangement of the first, second, third, fourth and fifth sets of idle rollers comprises a quincunx staggered arrangement.

* * * * *